United States Patent [19]

Kimura et al.

[11] Patent Number: 4,550,272

[45] Date of Patent: Oct. 29, 1985

[54] OPERATING CIRCUIT FOR ELECTRIC DISCHARGE LAMP

[75] Inventors: Mitsutoshi Kimura; Masayuki Morita, both of Yokohama, Japan

[73] Assignee: Tokyo Shibaura Denki Kabushiki Kaisha, Kawasaki, Japan

[21] Appl. No.: 591,480

[22] Filed: Mar. 20, 1984

[30] Foreign Application Priority Data

Mar. 30, 1983 [JP] Japan ..... 58-52676

[51] Int. Cl.[4] ..... H05B 37/00

[52] U.S. Cl. ..... 315/86; 315/92; 315/171; 315/194; 315/205

[58] Field of Search ..... 315/86, 92, 194, 205, 315/171

[56] References Cited

U.S. PATENT DOCUMENTS

| | | | |
|---|---|---|---|
| 3,066,243 | 11/1962 | Mutschler | 315/176 |
| 3,170,084 | 2/1965 | Retzer | 315/176 |
| 3,376,470 | 4/1968 | Stone | 315/176 |
| 3,444,430 | 5/1969 | Needham | 315/176 |
| 3,471,747 | 10/1969 | Gershen et al. | 315/205 |
| 3,474,290 | 10/1969 | Swain | 315/176 |
| 3,894,265 | 7/1975 | Holmes | 315/194 |
| 4,236,100 | 11/1980 | Nuver | 315/92 |

OTHER PUBLICATIONS

Japanese Utility Model Publication No. 57-19838, (Apr. 27, 1982), Ishii et al.

Japanese Utility Model Publication No. 57-35192, (Aug. 4, 1982), Ishii et al.

*Primary Examiner*—Harold Dixon

*Attorney, Agent, or Firm*—Oblon, Fisher, Spivak, McClelland & Maier

[57] ABSTRACT

There is disclosed an operating circuit for an electric discharge lamp in which a first DC operating circuit for starting an electric discharge lamp, a second DC operating circuit for making the electric discharge lamp operative by a voltage near a rated lamp voltage and by a current near a rated lamp current, and a third DC operating circuit for supplying a relatively large current to the electric discharge lamp immediately after the electric discharge lamp is started and for stabilizing the lamp luminous flux in a short time, are connected in parallel. A switching circuit for cutting off the first DC operating circuit after the electric discharge lamp is started is provided at the output terminal of the first DC operating circuit. In addition, reverse current preventing circuits for preventing the currents from reversely flowing from the operating circuits at higher voltages are provided at the output terminals of the second and third DC operating circuits.

6 Claims, 2 Drawing Figures

α
β
γ
LAMP VOLTAGE $V_L$
$V_L$
$I_L$
LAMP CURRENT $I_L$

OPERATING CIRCUIT FOR ELECTRIC DISCHARGE LAMP

BACKGROUND OF THE INVENTION

The present invention relates to an operating circuit for an electric discharge lamp which can shorten the starting time, restriking time and the stabilization time of the luminous flux, and can improve the overall reliability of the circuit.

Conventionally, there has been known a circuit for operating an electric discharge lamp in which two operating circuits having different load characteristics, respectively, are connected in parallel to operate HID (high intensity discharge) lamp such as a metal halide lamp or xenon lamp by DC power source. For example, in U.S. Pat. No. 3,471,747 and Japanese Utility Model Publication No. 19838/82, there is disclosed a circuit in which an operating circuit for supplying the starting voltage and another operating circuit for lighting an electric discharge lamp at a rated voltage are connected in parallel.

In addition, in Japanese Utility Model Publication No. 35192/82, there is disclosed a circuit for lighting an electric discharge lamp in which a DC power supply for supplying a predetermined constant current to the electric discharge lamp is connected in a series with another DC power supply which supplies a current larger than the predetermined current to the electric discharge lamp when starting the electric discharge lamp, and through which the above-mentioned predetermined current flows when the electric discharge lamp becomes stable. However, none of these circuits disclose a parallel circuit of an operating circuit for starting an electric discharge lamp, an operating circuit for stabilizing the electric discharge lamp in its early stage, and an operating circuit for lighting the electric discharge lamp at a rated voltage.

In electric discharge lamps, such as a metal halide lamp where the starting voltage is high, it takes a long time for the lamp characteristics, for example, a lamp voltage and lamp luminuous flux, to become stable after the lamp is lit. A sufficient amount of high voltage is required for starting the electric discharge lamp, and, at the same time, a sufficiently large current is needed immediately after the lamp is started.

Furthermore, in a conventional circuit in which the operating circuits for applying high voltage are connected in parallel to ignite an electric discharge lamp, the current continues to be supplied from the operating circuits for starting to the electric discharge lamp long after the lamp has started and is stably operating. This is undesirable in terms of the reliability of the circuit.

SUMMARY OF THE INVENTION

It is an object of the present invention to provide an operating circuit for an electric discharge lamp which can shorten the starting and restriking time of the electric discharge lamp, which can shorten the stabilization time of the luminous flux, and which can improve the overall reliability of the circuit while enabling it to be easily designed.

An operating circuit for an electric discharge lamp according to the present invention which accomplishes the above objectives comprises: a first DC operating circuit for supplying a DC output voltage higher than a rated lamp voltage to the electric discharge lamp to start the electric discharge lamp and for making the electric discharge lamp operative by a current smaller than a rated lamp current; a second DC operating circuit, connected in parallel to the first DC operating circuit, for making the electric discharge lamp operative by a voltage near the rated lamp voltage, and by a current near the rated lamp current; a third DC operating circuit, connected in parallel to the first and second DC operating circuits, for making the electric discharge lamp operative by using a current larger than the rated lamp current itself when the electric discharge lamp has a lamp voltage lower than the rated lamp voltage; a switching circuit for detecting the predetermined electrical characteristic of the electric discharge lamp after the electric discharge lamp has started, and for cutting off the first DC operating circuit from the electric discharge lamp; a first reverse current preventing circuit, connected in series to the second DC operating circuit, for preventing the current from reversely flowing from the first DC operating circuit to the second DC operating circuit; and a second reverse current preventing circuit, connected in series to the third DC operating circuit, for preventing the currents from reversely flowing from the first and second DC operating circuits to the third DC operating circuit.

With the above constitution, it is possible to easily ignite a HID lamp having a high starting voltage, such as a metal halide lamp or high pressure sodium lamp, and at the same time the lamp characteristic can be immediately stabilized even in an electric discharge lamp such as a HID lamp which takes a long time to stabilize the lamp characteristic.

Furthermore, since the first DC operating circuit is cut off from the circuits after the electric discharge lamp is started, no additional current is supplied from the first DC operating circuit to the electric discharge lamp. Therefore, the electric discharge lamp can be stably operated, thus improving the reliability of the circuit.

Moreover, since a first and second reverse current preventing circuits and a switching circuit are provided, the first, second and third DC operating circuits are not mutually subjectd to interaction. In this way, the respective circuits can be designed to have the desired characteristics.

In addition, it is enough to use the three operating circuits each of which has the required voltage range. For example, it is possible to use a DC operating circuit with a small capacity as the first DC operating circuit for starting the lamp because although it operates at a high voltage, the current flow is small. A circuit parameter of the second DC operating circuit may be selected so as to only execute the rated operation. On the other hand, the large current which flows through the third DC operating circuit can also stabilize the lamp in its early stages. However, since the operating voltage is low, the third DC operating circuit which has a small capacity may be also used. Because of the combination of these 3 circuits, the whole apparatus can be reduced in size.

BRIEF DESCRIPTION OF THE DRAWINGS

Other objects and advantages will be apparent from the following description taken in conjunction with the accompanying drawings, in which.

DETAILED DESCRIPTION OF THE PREFERRED EMBODIMENTS

Figure 1:
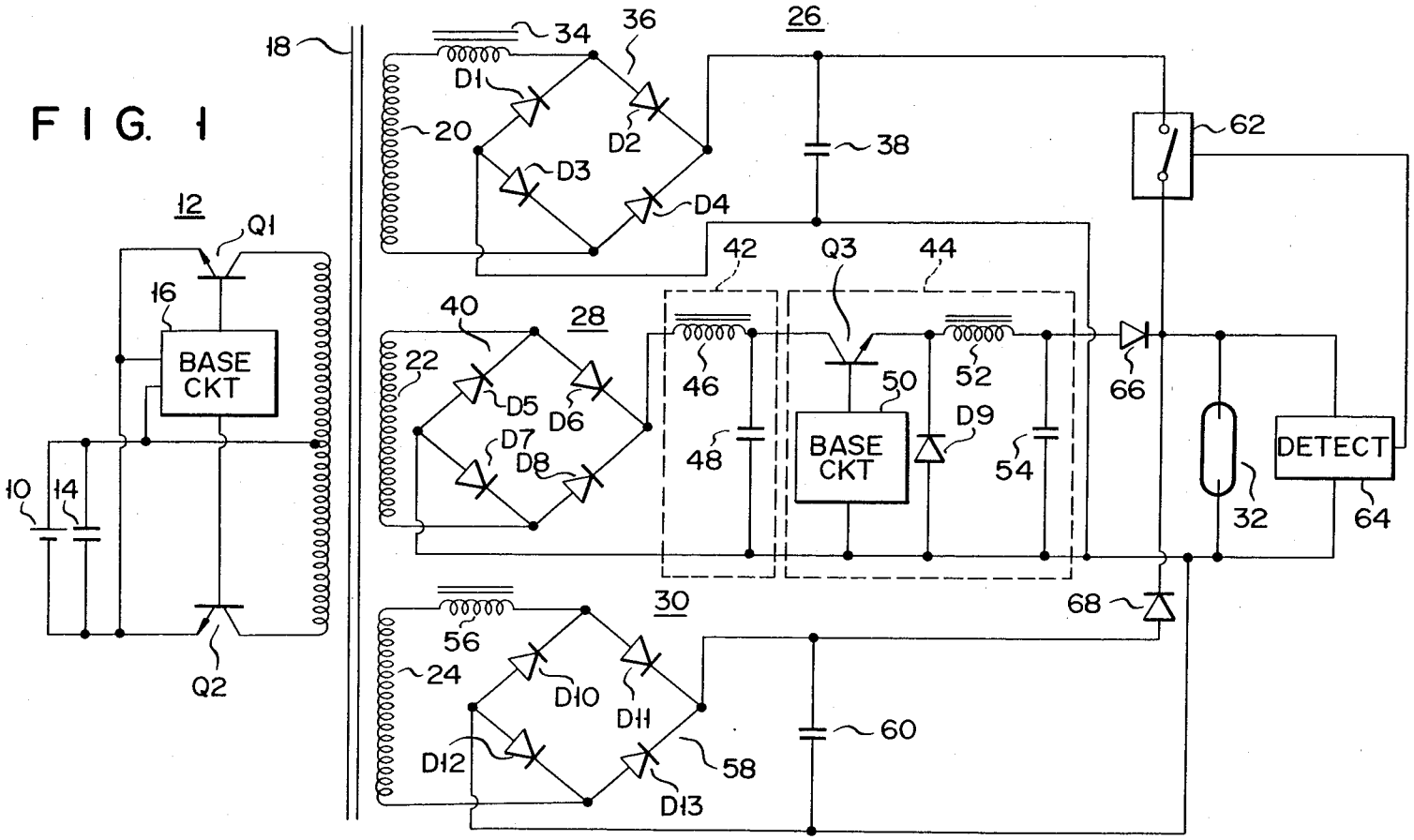
FIG. 1 is a circuit diagram showing an embodiment of operating circuits for an electric discharge lamp according to the present invention.
Figure 2:
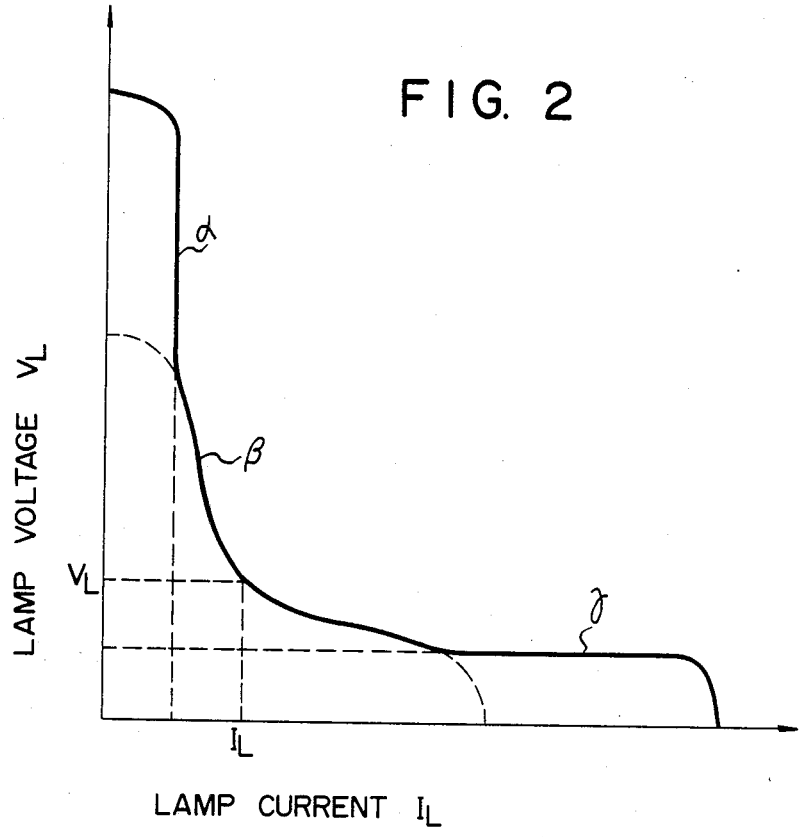
FIG. 2 shows a load characteristic diagram of the operating circuits for an electric discharge lamp of FIG. 1.

An embodiment of operating circuits for an electric discharge lamp according to the present invention will be described with reference to FIGS. 1 and 2. In FIG. 1, the DC voltage supplied from a DC power supply 10 is converted into AC voltage by a boosting push-pull inverter 12. The inverter 12 comprises: a capacitor 14; npn transistors Q1 and Q2; a base drive circuit 16 for driving the bases of the transistors Q1 and Q2; and an output transformer 18. The capacitor 14 is connected to both ends of the DC power supply 10. The collector of the transistor Q1 is connected to one end of the primary winding of the transformer 18; the emitter is connected to the minus terminal of the DC power supply 10; and the base is connected to the base drive circuit 16. The collector of the transistor Q2 is connected to the other end of the primary winding of the transformer 18; the emitter is connected to the minus terminal of the DC power supply 10; and the base is connected to the base drive circuit 16. The plus terminal of the DC power supply 10 is connected to the intermediate tap of the primary winding and at the same time it is connected to the respective input terminals of the drive circuit 16 of the transistors Q1 and Q2. The transformer 18 is provided with three secondary windings 20, 22 and 24. By alternately switching the transistors Q1 and Q2 by the drive circuit 16, the predetermined AC voltages are generated in the secondary windings 20, 22 and 24 of the transformer 18. The secondary winding 20 serves to supply electric power to a first DC operating circuit 26. The secondary winding 22 serves to supply electric power to a second DC operating circuit 28, and further the secondary winding 24 serves to supply electric power to a third DC operating circuit 30. The first, second and third DC operating circuits 26, 28 and 30 are respectively connected in parallel and serve to make an electric discharge lamp, e.g., a metal halide lamp 32, operative.

The first DC operating circuit 26 comprises: an inductor 34 for limiting the current to be supplied to the electric discharge lamp 32; a full-wave rectifier circuit 36 for converting the AC voltage which is generated in the secondary winding 20 into a DC voltage; and a smoothing capacitor 38. The full-wave rectifier circuit 36 is a full-wave bridge rectifier circuit consisting of diodes D1, D2, D3 and D4. This first DC operating circuit 26 supplies an electric power of, for example, 600 V and a rated current of 0.1 A to start or to restrike the electric discharge lamp 32. This characteristic is shown by a curve $\alpha$ of FIG. 2. Because of this, sufficient voltage and current are supplied to the electric discharge lamp 32 so that the electric discharge rapidly changes from the glow discharge to the arc discharge. Furthermore, since a voltage higher than the reignition voltage of the electric discharge lamp 32 is supplied even immediately after the electric discharge lamp 32 is turned off, it is possible to turn it on again without waiting for the electric discharge lamp 32 to cool or for the reignition voltage to decrease. As described above, the first DC operating circuit 26 has the function to start the electric discharge lamp 32 and to easily restrike it. Therefore, since it is enough that this function is satisfied, this DC operating circuit 26 may be independently designed without considering other circuit conditions. Thus, it is possible to manufacture a small DC operating circuit with a relatively small capacity.

The second DC operating circuit 28 comprises: a full-wave rectifier circuit 40 connected to the secondary winding 22; a smoothing circuit 42 connected to the full-wave rectifier circuit 40; and a chopper circuit 44 connected to the smoothing circuit 42. The full-wave rectifier circuit 40 consists of diodes D5, D6, D7 and D8 which are bridge connected. The smoothing circuit 42 comprises an inductor 46 and a capacitor 48 which are connected in series between the output terminals of the full-wave rectifier circuit 40. The chopper circuit 44 comprises: a transistor Q3 whose collector is connected to the node of the inductor 46 and capacitor 48 and whose base is driven by a wellknown base drive circuit 50; a diode D9 connected to the emitter of the transistor Q3 and to the other end of the capacitor 48; and an inductor 52 and a capacitor 54 which are connected in series between the anode electrode and the cathode electrode of the diode D9. The second DC operating circuit 28 supplies the lamp electric power, for example of 40 W, to the electric discharge lamp 32 when the lamp voltage $V_L$ of the electric discharge lamp 32 becomes close to the rated lamp voltage 80 V. The lamp current $I_L$ at this time is 0.5 A. The load characteristic of the second DC operating circuit is shown by a curve $\beta$ of FIG. 2. The chopper circuit 44 serves to stably light the electric discharge lamp 32.

When the lamp current $I_L$ of the electric discharge lamp 32 increases, a pulse having a smaller duty ratio is applied from the base drive circuit 50 to the base of the transistor Q3 in order to reduce the lamp current $I_L$. In addition, when the lamp current $I_L$ of the electric discharge lamp 32 decreases, a pulse having a larger duty ratio is applied from the base drive circuit 50 to the base of the transistor Q3 in order to increase the lamp current $I_L$. The diode D9 is provided for allowing the current to flow through the inductor 52 even when the transistor Q3 is off. The current flowing through the inductor 52 flows through the capacitor 54 or electric discharge lamp 32 and further through the diode D9, thereby making a loop. As described above, the second DC operating circuit 28 is used merely to operate the electric discharge lamp 32 at the rated voltage. It is not always necessary to use the chopper circuit 44 to control the lamp current $I_L$ of the electric discharge lamp 32, but it may be possible to use a device such as, for example, the inductor 34 of the first DC operating circuit 26.

The third DC operating circuit 30 comprises: an inductor 56 connected to one end of the secondary winding 24; a full-wave rectifier circuit 58 connected to the other end of the secondary winding 24 and to the inductor 56; and a smoothing capacitor 60 connected to the output terminal of the full-wave rectifier circuit 58. The full-wave rectifier circuit 58 consists of diodes D10, D11, D12, and D13 which are bridge connected. This third DC operating circuit 30 supplies the electric power of, e.g., the lamp current 2A at the lamp voltage 20 V to the electric discharge lamp 32 when the lamp voltage $V_L$ drops immediately after the electric discharge lamp 32 has started. Since sufficient current is supplied to the electric discharge lamp 32 during the interval in which the lamp voltage of the electric discharge lamp 32 drops, the discharge quickly changes to an arc discharge and the temperature of the coolest portion of the electric discharge lamp 32 rapidly increases. This supplied current enables the lamp characteristic, particularly, the stabilization time of the luminous flux, to be shortened. In lamps, such as a metal halide lamp wherein a solid filling material is filled in the lamp and the lamp luminous flux is not saturated until the temperature becomes relatively high, it is necessary to supply a relatively large current to the lamp immediately after it is started. The load characteristic of the 3rd DC operating circuit 30 is shown by a curve $\gamma$ of FIG. 2.

A switching circuit 62 is provided between the first DC operating circuit 26 and the lamp 32. This switching circuit 62 responds to a detection signal from the detecting circuit 64 which detects, e.g., the lamp voltage $V_L$ across the lamp 32. When the lamp voltage $V_L$ has a predetermined value, after the voltage is supplied from the first DC operating circuit 26 to the lamp 32 and the lamp 32 is started, the switching circuit 62 is made operative, so that the first DC operating circuit 26 is cut off from the circuits. Unless this switching circuit 62 is provided, a current will be continuously supplied from the first DC operating circuit 26 to the lamp 32 even while the lamp 32 operating stably at the rated voltage.

Therefore, it is necessary to design the first and second DC operating circuits 26 and 28 while considering this fact. However, if the switching circuit 62 is provided, the first DC operating circuit 26 will serve only to start and restrike the lamp. Therefore, the first and second DC operating circuits 26 and 28 can be independently designed. For example, a photo coupler may be used as the detecting circuit 64. In addition, the switching circuit 62 may be constituted by, e.g., a relay. Furthermore, a detecting circuit 64 may be used to detect the lamp current $I_L$.

A diode 66 is provided at the output terminal of the second DC operating circuit 28. This diode 66 acts to prevent the current from reversely flowing from the first DC operating circuit 26 to the second DC operating circuit 28. Furthermore, a diode 68 is provided at the output terminal of the third DC operating circuit 30. This diode 68 acts to prevent the current from reversely flowing from the first and second DC operating circuits 26 and 28 to the third DC operating circuit 30. By providing these diodes 66 and 68, it is possible to independently design the first, second and third DC operating circuits 26, 28 and 30, respectively. Consequently, the first, second and third DC operating circuits 26, 28 and 30 can be independently designed on the basis of the necessary conditions with respect to: the voltage and current necessary to start and restrike the electric discharge lamp 32; the rated lamp voltage and rated lamp current of the electric discharge lamp 32; the time necessary to saturate the lamp luminous flux of the electric discharge lamp 32; and the like.

The present invention is not limited to the above embodiment. The diodes 66 and 68 which are provided for prevention of the reverse current may be replaced by switching circuits such as, e.g., the switching circuit 62. Also, the switching circuit 62 may be replaced by an electronic circuit such as a transistor, thyristor, or the like instead of the relay circuit.

What is claimed is:

1. Operating circuit for an electric discharge lamp comprising:

first DC operating means for supplying a DC output voltage higher than a rated lamp voltage to said electric discharge lamp to start the electric discharge lamp and for making the electric discharge lamp operative by a current smaller than a rated lamp current;

second DC operating means, connected in parallel to said first DC operating means, for making said electric discharge lamp operative by a voltage near the rated lamp voltage and by a current near the rated lamp current;

third DC operating means, connected in parallel to said first and second DC operating means, for making the electric discharge lamp operative by a current larger than said rated lamp current when the electric discharge lamp has a lamp voltage lower than the rated lamp voltage;

switching means for detecting the predetermined electrical characteristic of the electric discharge lamp after the electric discharge lamp has started, and for cutting off said first DC operating means from the electric discharge lamp;

first reverse current preventing means, connected in series to said second DC operating means, for preventing the current from reversely flowing from said first DC operating means to said second DC operating means; and second reverse current preventing means, connected in series to said third DC operating means, for preventing the currents from reversely flowing from said first and second DC operating means to said third DC operating means.

2. Operating circuit for an electric discharge lamp according to claim 1, wherein said switching means is a relay circuit which operates when said electric discharge lamp reaches a predetermined lamp voltage.

3. Operating circuit for an electric discharge lamp according to claim 1, wherein said switching means is a relay circuit which operates in response to a predetermined lamp current which flows through said electric discharge lamp.

4. Operating circuit for an electric discharge lamp according to claim 1, wherein said first and second reverse current preventing means are diodes.

5. Operating circuit for an electric discharge lamp according to claim 1, wherein switching means is an electronic circuit which operates when said electric discharge lamp reaches a predetermined lamp voltage.

6. Operating circuit for an electric discharge lamp according to claim 1, wherein switching means is an electronic circuit which operates in response to a predetermined lamp current which flows through said electric discharge lamp.

* * * * *